US005626200A

United States Patent [19]

Gilbert et al.

[11] Patent Number: 5,626,200

[45] Date of Patent: May 6, 1997

[54] SCREEN AND BYPASS ARRANGEMENT FOR LWD TOOL TURBINE

[75] Inventors: Gregory N. Gilbert, Missouri City; Martin L. Tomek, Houston, both of Tex.

[73] Assignee: Halliburton Company, Houston, Tex.

[21] Appl. No.: 476,970

[22] Filed: Jun. 7, 1995

[51] Int. Cl.[6] ..... E21B 47/18

[52] U.S. Cl. ..... 175/40

[58] Field of Search ..... 175/40, 45; 367/83, 367/85

[56] References Cited

U.S. PATENT DOCUMENTS

| | | | |
|---|---|---|---|
| 2,940,039 | 6/1960 | Yost et al. | 175/40 |
| 3,737,843 | 6/1973 | Le Peuvedic et al. | 367/85 |
| 4,532,614 | 7/1985 | Peppers | 367/83 X |
| 4,630,243 | 12/1986 | MacLeod | 175/42 X |
| 5,119,344 | 6/1992 | Innes | 367/84 |
| 5,182,731 | 1/1993 | Hoelscher et al. | 367/84 |
| 5,249,161 | 9/1993 | Jones et al. | 367/83 |
| 5,285,204 | 2/1994 | Sas-Jaworsky | 175/40 X |
| 5,295,548 | 3/1994 | Yuasa et al. | 175/40 |
| 5,517,464 | 5/1996 | Lerner et al. | 367/84 |

*Primary Examiner*—Hoang C. Dang

*Attorney, Agent, or Firm*—Gilbreth & Strozier, P.C.; J. M. (Mark) Gilbreth; R. W. Strozier

[57] ABSTRACT

A logging-while-drilling tool for use in a wellbore in which a well fluid is circulated into the wellbore through the hollow drill string. In addition to measurement electronics, the tool includes an alternator for providing power to the electronics, and a turbine for driving the alternator. The turbine blades are driven by the well fluid introduced into the hollow drill string. The tool also includes a deflector to deflect a portion of the well fluid away from the turbine blades.

8 Claims, 3 Drawing Sheets

SCREEN AND BYPASS ARRANGEMENT FOR LWD TOOL TURBINE

BACKGROUND OF THE INVENTION

1. Field of the Invention

The present invention relates to logging-while-drilling ("LWD") tools and to methods of operating logging while drilling. In another aspect, the present invention relates to LWD tools having turbine blades which, when driven by the circulating well fluid provides electrical power to the tool, and to a method of operating such a tool. In even another aspect, the present invention relates to LWD tools having a deflector for deflecting a portion of the circulating well fluid away from the turbine blades, and to a method of operating such a tool.

2. Description of the Related Art

Logging While Drilling Tools (LWD) are used to provide real-time quantitative analysis of sub-surface formations during the actual drilling operation. Typically, these quantitative measurements include: formation resistivity, neutron and density porosity, and acoustic travel time of the formations of interest. Due to the fact that the LWD tool string is an integral part of the bottom hole assembly, it is impractical to connect an umbilical (i.e. wireline) from the surface to provide the electrical power required by the various LWD components.

In the prior art, there have been primarily two sources of electrical power for downhole LWD tools. These include: 1) lithium batteries; and 2) downhole turbine/alternator power supplies. Lithium batteries have been used reliably in both LWD and Measurement While Drilling (MWD) applications for quite some time. The major shortcomings of the lithium batteries are: 1) the batteries have a finite life; 2) they have a limited maximum current rating; 3) once the batteries are "used-up", there are difficulties associated with the proper disposal of the depleted cells; and 4) the batteries tend to be a safety concern if mishandled. Due to the relatively large power requirements of modern LWD tools, turbine/alternator power supplies are commonly used. In turbine/alternator power supplies, mechanical power is extracted from the flow of drilling fluid by means of a fluidic turbine. The rotational output of the turbine is coupled to the input of a permanent magnet alternator which, by means of electronic regulation, is used to power the LWD tool string. Turbine/alternator power supplies have the advantage of providing relatively large amounts of electrical power. This is due to the fact that the flow of drilling fluid provides an extremely large amount of mechanical power available for conversion. Also, turbine/alternator power supplies are able to provide electrical power theoretically for as long as the drilling fluid is circulating, thereby extending the downhole life of the LWD tool string.

There have been numerous shortcomings with turbine/alternator power supplies. Due to the fact that the turbine is extracting mechanical power directly from the drilling fluid flow, a large amount of erosion is typically encountered on and adjacent to the turbine's rotating elements. Depending on the LWD tool size (i.e. outside diameter) a wide range of drilling fluid flow must be accommodated. In order to accommodate the wide flow range typically encountered in LWD tools, several turbine blade arrangements must be adaptable to the turbine/alternator power supply. This obviously adds overall system cost and the possibility of human error in appropriately selecting the turbine blade arrangement required for a given drilling (i.e. flow rate) condition. Also, because the turbine blades are positioned directly in the path of the drilling fluid flow, they are extremely susceptible to jamming or plugging by debris such as pipe scale or "lost circulation materials" commonly encountered in drilling environments.

As an additional shortcoming, turbines of commonly utilized downhole turbine/alternator power supplies are outfitted with blades which occupy the entire flow annulus. These "full-bore" turbines are highly susceptible to plugging or jamming by debris present in the flow. In an effort to reduce the risk of plugging in existing turbines, the blades themselves are designed with large clearances, both radially at the blade tips of the turbine rotor and axially between the turbine stator and rotor, to allow the passage of debris. As a result of these large blade clearances, the turbines themselves are fairly inefficient and extremely susceptible to erosion due to the formation of vorticity.

There is a need in the art for an improved LWD tool/turbine arrangement.

There is another need in the art for a turbine arrangement that is less susceptible to jamming or plugging by debris such as pipe scale or "lost circulation materials" commonly encountered in drilling environments.

There is even another need in the art for an LWD tool turbine arrangement having improved efficiency over prior art LWD tool turbine arrangements.

These and other needs in the art will become apparent to those of skill in the art upon review of this patent specification, including its claims and drawings.

SUMMARY OF THE INVENTION

It is an object of the present invention to provide for an improved LWD tool/turbine arrangement.

It is another object of the present invention to provide for a turbine arrangement that is less susceptible to jamming or plugging by debris such as pipe scale or "lost circulation materials" commonly encountered in drilling environments.

It is even another object of the present invention to provide for an LWD tool turbine arrangement having improved efficiency over prior art LWD tool turbine arrangements.

These and other objects of the present invention will become apparent to those of skill in the art upon review of this patent specification, including its claims and drawings.

According to one embodiment of the present invention there is provided a logging-while-drilling tool for use in a wellbore. In a drilling operation, a well fluid is circulated into the wellbore through the hollow drill string. The tool generally includes an elongated tool body adapted to be positioned within the hollow drill string and sized to form an annulus between the drilling string and the tool body. The tool also includes a drilling string coupling attached to the tool body for coupling the tool to the drill string. The tool further includes measurement electronics attached to the tool body for gathering wellbore information, such as formation resistivity, neutron and density porosity, and acoustic travel time of the formations of interest. The tool even further includes an alternator attached to the tool body for generating electrical power for the measurement electronics. The tool still further includes a turbine attached to the tool body, and having blades adapted to be driven by the well fluid being circulated into the wellbore through the hollow drill string. The tool finally includes, a deflector positioned adjacent the turbine blades, and adapted to deflect a portion of the well fluid away from the turbine blades into the annulus.

According to another embodiment of the present invention there is provided a method of operating a logging-while-drilling tool positioned within a hollow drilling string positioned within a wellbore. The tool generally includes measurement electronics, an alternator for providing electrical power to the electronics, and a turbine for driving the alternator. The method includes pumping a well fluid into the hollow drilling string into contact with the blades of the turbine and drive the alternator and generate electrical power for the electronics. The method further includes deflecting a portion of the injected well fluid away from the turbine.

DETAILED DESCRIPTION OF THE INVENTION

Figure 1:
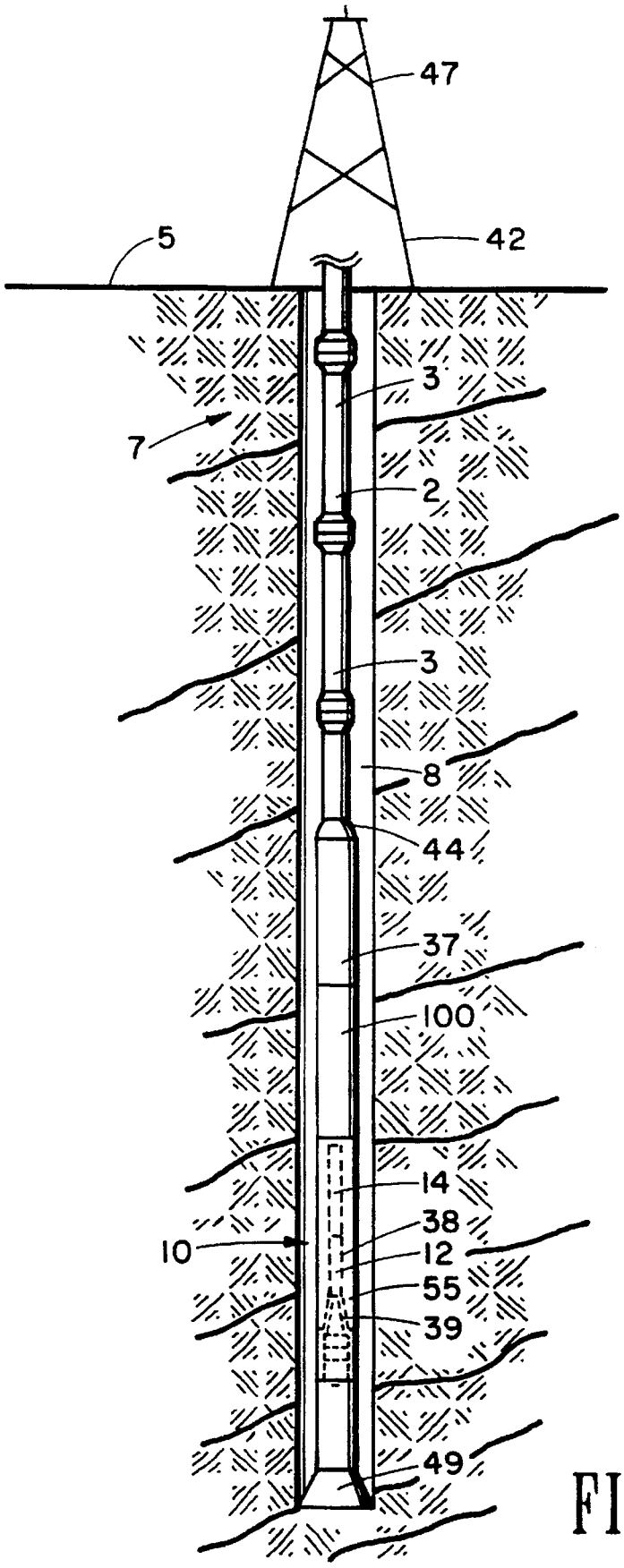
FIG. 1 is an illustration of a typical drilling operating showing drilling rig 42 and logging while drilling ("LWD") tool 100.

The present invention will first be explained by reference to FIG. 1 which is an illustration of a typical drilling operation showing drilling rig 42 and logging while drilling ("LWD") tool 100.

Drilling rig 42 is generally a rotary drilling rig which as is well known in the drilling art, and comprises a mast 47 which rises above ground 5. Rotary drilling rig 42 is fitted with lifting gear from which is suspended a drill string 2 formed of a multiplicity of drill pipes 3 screwed one to another and having at its lower end a drill bit 49 for the purpose of drilling a wellbore 8.

Drilling mud is injected into wellbore 8 via the hollow pipes 3 of drill string 2. The drilling mud is generally drawn from a mud pit which may be fed with surplus mud from the wellbore 8.

The LWD tool 100 is located near the bottom of drill string 2 and may be attached to drilling string 2 by any suitable manner known to those of skill in the art, including with coupling 44 as shown.

LWD tool 100 includes LWD tool body 37 in which is housed power supply assembly 10. Although not shown, tool 100 further includes any desired instrumentation for measuring formation resistivity, neutron and density porosity, and acoustic travel time of the formations of interest. This data is processed in electronics assembly 14. Electrical power for LWD tool 100 is provided by power supply assembly 10 which includes a turbine/alternator assembly 12.

Turbine/alternator assembly 12 includes alternator assembly 18 having alternator 38 positioned within alternator housing 19. Turbine/alternator assembly 12 further includes turbine 39, having bearing housing 23, turbine shaft 20, turbine stator 26, shroud 29, seal assembly 22 and turbine rotor 28.

Figure 2:
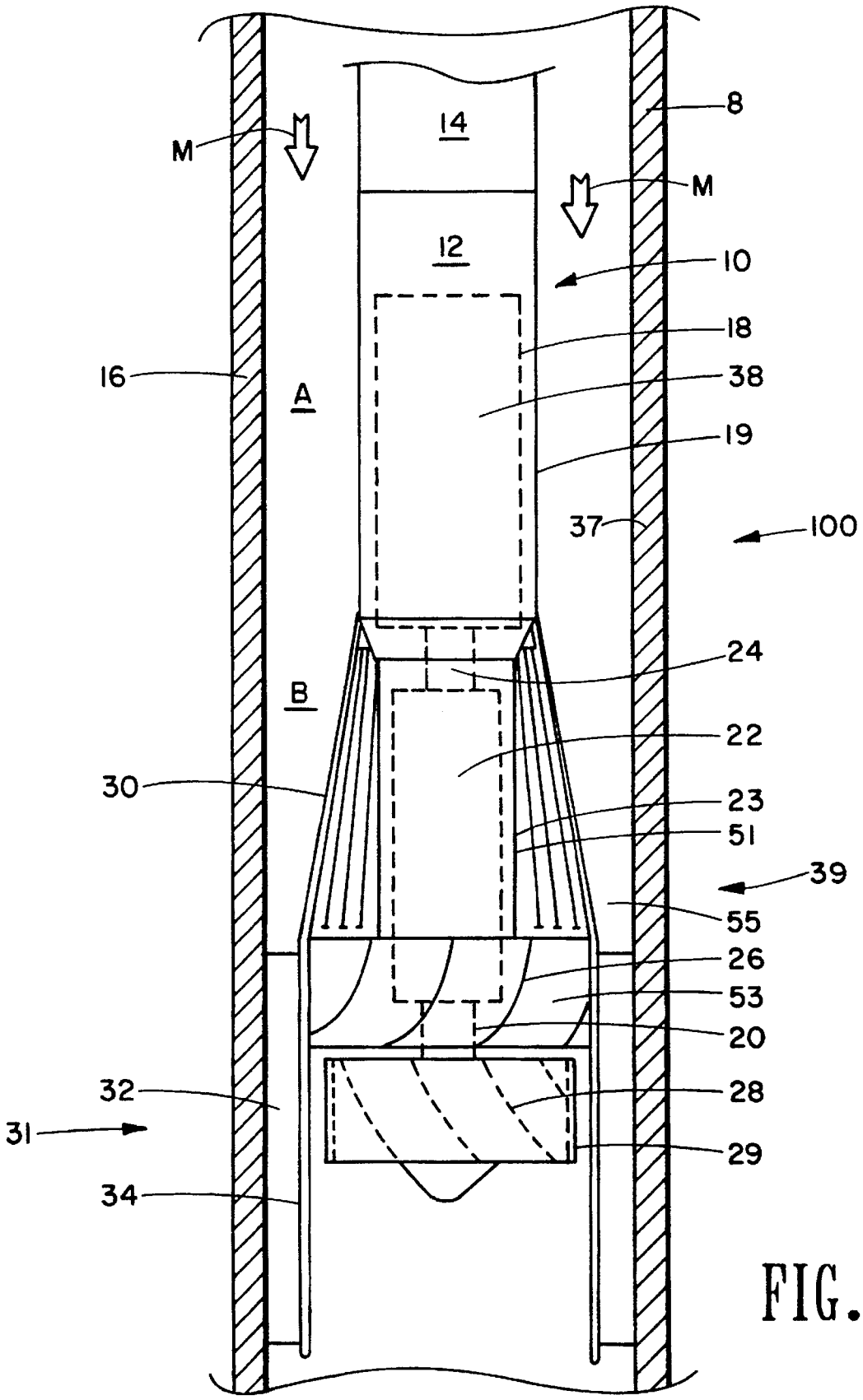
FIG. 2 is an illustration of an enlarged cross-sectional portion of LWD tool 100 of FIG. 1 in the region of collar 16, showing electronics assembly 14, turbine assembly 12, screen 30, alternator 38, turbine 39 and bypass assembly 31.
Figure 3:
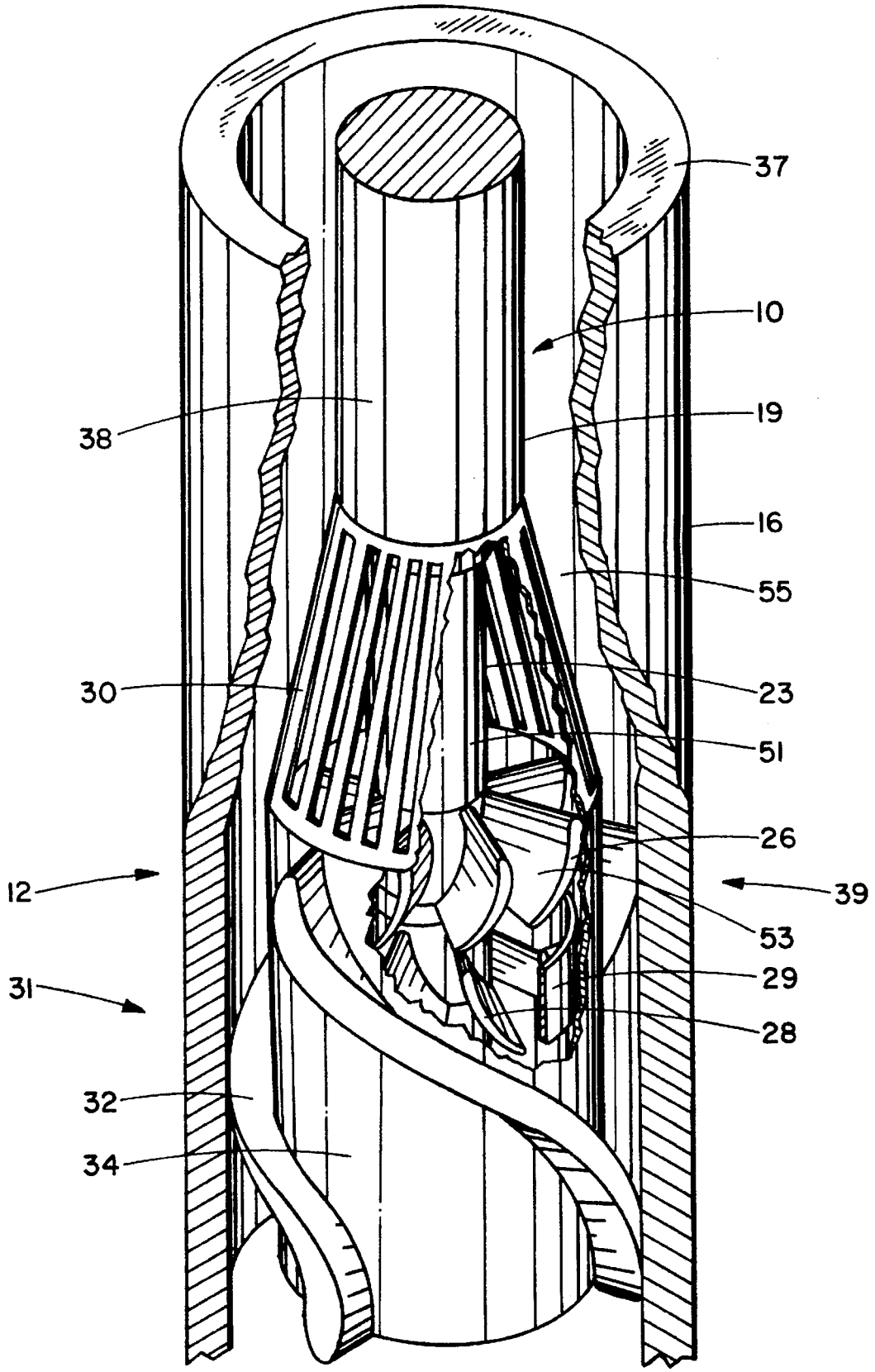
FIG. 3 is an illustration of an enlarged isometric portion of LWD tool 100 of FIG. 1 in the region of collar 16, showing electronics assembly 14, turbine assembly 12, screen 30, alternator 38, turbine 39 and bypass assembly 31.

Referring additionally to FIG. 2, there is shown illustrated an enlarged cross-sectional portion of LWD tool 100 of FIG. 1, and to FIG. 3 there is shown illustrated an enlarged isometric portion of LWD tool 100 of FIG. 1.

As is shown in FIGS. 1–3, turbine/alternator assembly 12 is positioned within the inside diameter of drill collar 16, alternator assembly 18 is contained within the alternator housing 19, and turbine shaft bearings 51 and seal assembly 22 are contained within bearing housing 23.

The turbine/alternator assembly 12 is positioned within the collar 16 so that the flow of drilling fluid is in annulus 55 formed between the I.D.D. of collar 16 and the outside of the turbine/alternator assembly 12. As is illustrated in FIG. 2, the mud or drilling fluid flows in the downward direction as indicated by arrows M. At a given flowrate, the mean velocity of the flow M is directly proportional to the cross-sectional area of the flow annulus 55. At region A, the flow annulus 55 is defined by the O.D.D. of collar 16 and the O.D. of the alternator housing 19. As the flow M progresses downward to region B, the mud flow comes in contact with the slotted conical shaped screen/deflector 30. Simultaneously, the mud flow is aligned within a region of increased cross-sectional flow area, due to the fact that as the mud flow progresses downward along the turbine/alternator assembly 12, the instant that the flow comes in contact with the screen/deflector 30, it also encounters the reduced O.D.D. of the bearing housing 23 which increases the annular cross-sectional area exposed to the flow. This sudden increase in cross-sectional area creates a relative stagnation region in the flow field. At this point the flow is split; a portion of the flow proceeds through the conical screen/deflector 30 and a remaining portion flows through the flow bypass 32 at the O.D.D. of the bypass sleeve 34. The portion of the mud flow which passes through the screen/deflector 30 proceeds through the I.D. of the bypass sleeve 34 and through the turbine stator 26 and rotor 28 at which point rotational mechanical energy is extracted from the flow to drive the alternator assembly 38. A major benefit of the relative stagnation region experienced by the flow as it reaches the screen/deflector 30 is that it allows the portion of the flow which passes through the screen to evenly disperse across all of the open area of the screen. This, in turn, prevents excessive localized flow velocities through the screen which drastically reduces erosion.

The presence of the flow bypass 32 and bypass sleeve 34 allows the adaptation of the slotted, conical-shaped screen/deflector 30 to the turbine/alternator assembly 12. The screen/deflector 30 allows only filtered flow to pass through the turbine blades 26 and 28, thus drastically reducing the risk of plugging or jamming by debris. Any particles which are too large to pass through the slotted screen/deflector 30 are harmlessly deflected to the outside of the bypass sleeve 34 and through the flow bypass 32.

The utilization of the slotted screen/deflector 30, as in the present invention, prevents debris generated in the drilling operation from coming in contact with turbine blades 53, and thus allows the use of highly efficient, small clearance blade designs. Also, to further eliminate the formation of erosive tip vorticity on the turbine rotor, an attached cylindrical thin-walled shroud 29 is provided on the outside diameter of the rotor 28. This "shrouded" rotor design drastically improves the wear characteristics of the rotor 28 and adjacent hardware and thereby greatly increases the downhole operating life of the entire system.

In operation, as fluid flows through the turbine stator 26 and rotor 28, a pressure drop is encountered in the flow. That is, the pressure at the inlet of the turbine stator 26 is higher than the pressure at the exit of the turbine rotor 28. This drop in pressure across the turbine blades is related to the actual mechanical power extracted from the flow by the turbine. There is a minimum threshold for the required mechanical power generated by the turbine in order to adequately power the alternator and thus, the LWD system. This minimum threshold corresponds to a minimum acceptable flow rate through the actual turbine blades which, in the present turbine/alternator assembly 12, is 125 gpm. Because of the existence of the flow bypass 32, for any given LWD tool size (i.e. 6¾", 8", 9½") the actual flow range through the turbine blades will be the same. For example, the minimum flow rate for a typical 6¾" LWD configuration may be about 250 gpm at which, due to the presence of the flow bypass 32, about 125 gpm passes through the conical screen/deflector 30 and through the turbine blades 53, and the remaining about 125 gpm passes through the flow bypass 32. Similarly, the maximum flow rate for a typical 6¾" LWD configuration may be about 750 gpm at which about 375 gpm passes through the turbine and the remaining about 375 gpm passes through the flow bypass 32. This means that in the 6¾" configuration, about 50% of the flow passes through the turbine 39 and about 50% passes through the bypass assembly 31. In order to prevent excessive erosion, the flow bypass is constructed so that the cross-sectional area perpendicular to the flow through the bypass is large enough to prevent high average velocities. For example, for the 6¾" configuration shown in FIG. 3, blades 53 of the bypass 32 are spiraled in order to create an appropriate balance in pressure drop between the bypassed flow and the flow which passes through the screen/deflector 30 and turbine blades 26 and 28.

For larger LWD tool sizes (i.e. 8" and 9½"), the percentage of the total flow which passes through the turbine blades 53 is reduced in comparison to the 50% of the flow utilized in the 6¾" configuration. For example, in a typical 8" tool, the flow bypass may be configured so that about 33% of the total flow passes through the turbine blades 53 and about 67% is bypassed. As another example, in the typical 9½" tool, the flow bypass is configured so that only about 25% of the total flow passes through the turbine blades while the remaining about 75% is bypassed. In both examples, of the typical 8" and 9½" configurations, the cross-sectional flow areas of the bypass arrangements are adequate to prevent excessive erosion at the respective maximum flow limits. In any of the three given example tool sizes, the same range of flow is directed through the screen/deflector 30 and turbine blades 53 for power generation. Thus, the actual percentage of flow bypass will generally be varied between different tool sizes.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

We claim:

1. A logging-while-drilling tool for use in a wellbore having a hollow drill string positioned in the wellbore, wherein a well fluid is being circulated into the wellbore through the hollow drill string, the tool comprising:

(a) an elongated tool body adapted to be positioned within the hollow drill string and sized to form an annular fluid flow passage between the drilling string and the tool body for allowing passage of the drilling fluid;

(b) drilling string coupling attached to a top end of the tool body for coupling the tool to the drill string;

(c) measurement electronics attached to the tool body for gathering wellbore information;

(d) an alternator attached to the tool body for generating electrical power for the measurement electronics;

(e) a turbine attached to the tool body, and having blades adapted to be driven by the well fluid being circulated through the annular fluid flow passage; and (f) a deflector positioned on the tool between the top end and the turbine, and adapted to cause a portion of the well fluid to bypass the turbine blades.

2. The tool of claim 1 wherein the deflector is a screen.

3. The tool of claim 2 wherein the deflector is a slotted screen.

4. The tool of claim 1 wherein the turbine further comprises a shroud around the turbine blades.

5. The tool of claim 4 wherein the deflector is a slotted screen.

6. A logging-while-drilling tool for use in a wellbore having a hollow drill string positioned in the wellbore with the string having an inner diameter D, wherein a well fluid is being circulated into the wellbore through the hollow drill string, the tool comprising:

(a) an elongated tool body having upper and lower portions of diameter D1 and D3, respectively, and a middle portion of diameter D2, with D>D3>D1>D2, such that tool body can be positioned within the hollow drill string to form an annular fluid flow passage between the drilling string and the tool body for allowing passage of the drilling fluid, and wherein said passage has greater cross-sectional area at the middle portion of the tool than at the lower and upper portions of the tool;

(b) drilling string coupling attached to a top end of the tool body for coupling the tool to the drill string;

(c) measurement electronics attached to the tool body for gathering wellbore information;

(d) an alternator attached to the tool body for generating electrical power for the measurement electronics;

(e) a turbine attached to the middle portion of the tool body, having blades adapted to be driven by the well fluid being circulated through the annular fluid flow passage; and (f) a deflector positioned on the tool between the top end and the turbine, and adapted to deflect a portion of the well fluid away from the turbine blades.

7. The tool of claim 6 wherein the deflector is a slotted screen.

8. The tool of claim 6 wherein the turbine further comprises a shroud around the turbine blades.

* * * * *